US005399020A

United States Patent [19]

Cheng

[11] Patent Number: 5,399,020

[45] Date of Patent: Mar. 21, 1995

[54] COLLAPSIBLE BAG WITH INTEGRAL COVER

[75] Inventor: Flora Cheng, Renton, Wash.

[73] Assignee: H.T.P. International Co., Ltd., Seattle, Wash.

[21] Appl. No.: 144,059

[22] Filed: Oct. 27, 1993

[51] Int. Cl.[6] ..... B65D 30/16; B65D 33/02; B65D 33/10; B65D 33/25

[52] U.S. Cl. ..... 383/4; 383/121; 383/127

[58] Field of Search ..... 383/4, 2, 127, 121

[56] References Cited

U.S. PATENT DOCUMENTS

| | | | |
|---|---|---|---|
| 717,621 | 1/1903 | Read | 383/121 |
| 1,553,697 | 9/1925 | Lederer | 383/4 |
| 2,493,085 | 1/1950 | Pincus | 383/2 |
| 2,682,290 | 6/1954 | Ditlea | 383/4 |
| 3,322,176 | 5/1967 | Geller | 383/4 |
| 4,011,898 | 3/1977 | Hubbard | 383/4 |
| 4,085,873 | 4/1978 | Schweitzer | 383/4 |
| 4,117,874 | 10/1978 | Berenguer | 383/4 |
| 4,782,874 | 11/1988 | Chartier | 383/4 |
| 5,289,906 | 3/1994 | Guidi | 383/4 |

FOREIGN PATENT DOCUMENTS

| | | | |
|---|---|---|---|
| 3002042 | 8/1981 | Germany | 383/127 |
| 681522 | 10/1952 | United Kingdom | 383/2 |

*Primary Examiner*—Stephen P. Garbe
*Attorney, Agent, or Firm*—Seed and Berry

[57] ABSTRACT

A bag is disclosed for carrying objects wherein the bag is constructed to be collapsed into a pouch for easy carrying. The bag is constructed from a flexible shell member having a bottom. A base support member is attached to the bottom of the bag for providing support to the bottom when the bag is in use. The bag is flexible so that it can be folded down to the base support member and the base support member folded and fastened with a zipper. In the folded and fastened configuration, the base support is constructed as a pouch. Another zipper is provided in the base support for closing an opening provided in the base support. When the bag is collapsed into the pouch, the second zipper cooperates with the bottom of the bag to define a pocket for storage of objects.

7 Claims, 1 Drawing Sheet

COLLAPSIBLE BAG WITH INTEGRAL COVER

TECHNICAL FIELD

The present invention relates to bags for carrying objects and, more particularly, to a collapsible bag including an integral cover.

BACKGROUND OF THE INVENTION

Flexible bags are commonly in use for carrying all types of objects. Currently, housewives, students, employees, and others, use flexible bags for carrying various objects such as groceries, books, school materials, lunches, shoes, etc. These flexible bags are typically on the order of 2–3 feet in length, 6–12 inches in width, and 3–4 feet in height. Many users of these flexible bags will fold the bag for transport when they are not in use. However, prior art flexible bags have not provided adequate means for storing the flexible bags when they are folded and not in use.

As a result of the foregoing inadequacy of prior art flexible bags, users typically employ another carrying device for storage of the flexible bags. Use of a second carrying container or use of no container at all, makes transport of the flexible bag inconvenient for its users. Accordingly, it is desirable to provide a flexible bag that includes a ready means for transporting the flexible bag when it is not in use.

SUMMARY OF THE INVENTION

The present invention is a bag for carrying objects wherein the bag is constructed to be collapsed into a pouch for easy carrying. The bag includes a shell member for providing the sides of the bag. The shell has top and bottom edges and a throughole extending from the top edge to the bottom edge. The shell is formed from a substantially flexible material. The bag also includes a base for providing support to the bottom of the bag. The base is formed from a covering material that is fixed to the bottom edge of the shell. The base has an area of a size sufficient to permit the shell to be folded upon the base. The area of the base includes first and second halves wherein a fastener is fixed to the periphery of the first and second halves for fastening the first half to the second half so that when the shell is folded upon the base, the first and second halves can be fastened together, thereby to create a pouch for carrying the bag wherein the base corresponds to a cover for the pouch.

In an alternative embodiment of the invention, the bag also includes a bottom fixed to the bottom edge of the shell intermediate the base and the shell. The bottom is also formed from a substantially flexible material. In this configuration, the first side portion of the base includes an opening. A second fastener is provided for closing the opening. The opening cooperates with the bottom and the second fastener for creating a pocket for storage of objects when the shell is folded and the fastener is fastened to create the pouch.

DETAILED DESCRIPTION OF THE INVENTION

Figure 1:
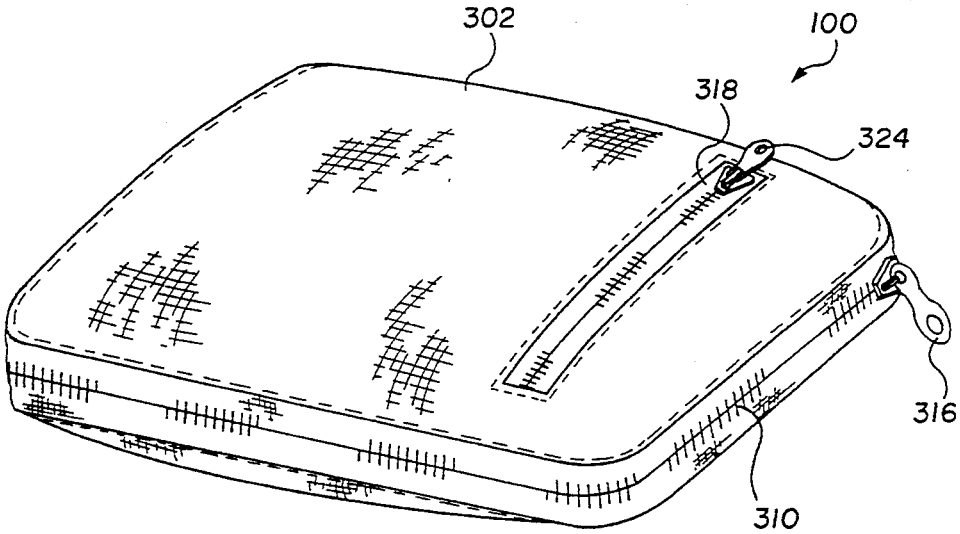
FIG. 1 is an illustration of the flexible bag of the subject invention when it is in its folded configuration to create a pouch.
Figure 2:
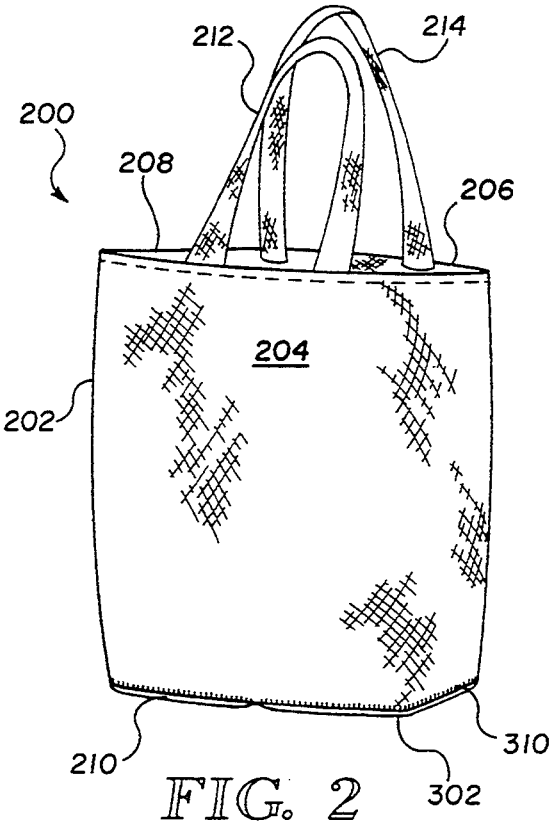
FIG. 2 is an illustration of the flexible bag when it is in its unfolded configuration and ready for use.

A bag 200 that is the subject of the present invention is illustrated in FIG. 2. In accordance with the present invention, the bag 200 is constructed to be folded into a pouch 100 (FIG. 1) for readily carrying. The bag 200 includes a hollow shell member 202 having first and second sides 204 and 206. The hollow shell 202 is formed from a panel made of a substantially flexible material. In the presently preferred embodiment of the invention, the flexible material comprises a heavy weight cotton canvas. However, those skilled in the art will appreciate that other materials could be readily replaced for the cotton canvas of the subject invention.

The panel of flexible material originally comprises a substantially planar panel formed in a rectangular fashion. The panel thus includes a top and bottom edge and first and second side edges. During construction, the first and second side edges are joined to create the hollow shell member 202, as is known in the art. When the first and second side edges of the panel are joined, the top and bottom edges of the panel correspond to top and bottom edges 208 and 210 of the hollow shell 202.

First and second handles 212 and 214 are provided for allowing a user to grip the bag. The first and second handles 212 and 214 are fixed to the first and second sides 204 and 206, respectively, at the top edge 208 of the hollow shell member 202. The first and second handles 212 and 214 are formed from strip of a flexible material. Preferably, the handles 212 and 214 are formed from the same flexible material as is the hollow shell member 202, i.e., a heavy weight cotton canvas. However, as discussed above, other flexible materials could be used for the heavy weight cotton canvas of the presently preferred embodiment of the invention. Furthermore, the material used for the first and second handles 212 and 214 could be different from the material used for the hollow shell 202.

Figure 3:
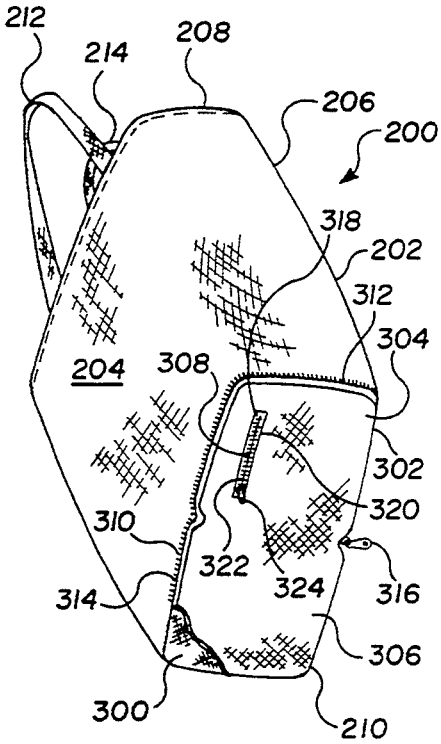
FIG. 3 is an illustration of the flexible bag in its unfolded configuration showing the base of the bag.

A bottom 300 (best illustrated in FIG. 3) is fixed to the bottom edge 210 of the hollow shell member 202. The bottom 300 is formed from a second panel of a substantially flexible material. The bottom has an area and a circumference sufficiently large to permit the hollow shell member 202 to be folded upon the bottom 300 so that the hollow shell member 202 is positioned inside the circumference of the bottom 300. The area of the bottom has a predetermined configuration constructed to mate with the configuration of the hollow shell 202. As illustrated in FIG. 3, the configuration of the hollow shell for the bag described herein is substantially rectangular. However, those skilled in the art will appreciate that other configurations could be employed without departing from the true scope of the present invention. Also, although the invention is described herein with the bottom as a separate piece from the hollow shell, those skilled in the art will appreciate that the bottom could be constructed to be integral with the shell, in whole or in part.

The bag 200 further includes a base support 302 that is fixed to the bottom 300. The base support 302 is formed from a covering material. Preferably, the covering material is a strong, durable, material of a heavier weight than the material selected for the hollow shell 202 and the first and second handles 212 and 214. Such a material will provide support to the bottom of the bag when it is in use. A durable material will also provide a good cover for the pouch 100 (illustrated in FIG. 1).

Presently preferred materials for the base support 302 include suede, leather, EVA, or other similar materials. However, those skilled in the art will appreciate that other materials could be used for the base support 302.

The base support 302 has a circumference that is slightly larger than the circumference of the bottom 300. Furthermore, the base support has an area that has substantially the same configuration as the area of the bottom 300. Moreover, the area of the base support 302 has a length and a width wherein the length is divided in substantial halves to define first and second side portions 304 and 306. In a presently preferred embodiment of the invention, the first side portion 304 includes an opening 308 as will be described in more detail below.

The base support 302 further includes a zipper 310 having first and second mating teeth portions that are constructed to be fastened by moving a sliding member 316, as is known in the art. The first and second mating teeth portions 312 and 314 are fixed to the periphery of the first and second side portions 304 and 306, respectively, so that when the hollow shell member 202 is folded upon the base support 302, the first and second side portions 304 and 306 can be folded together and the sliding member 316 moved to fasten the zipper 310 and thereby create the pouch 100 (FIG. 1) wherein the base support 302 provides a cover for the pouch 100.

Those skilled in the art will appreciate that although the present invention is described as including a zipper 310 for fastening the first and second side portions 304 and 306, other fasteners could be substituted therefor. As examples, velcro, snap enclosures, buttons, or other similar fasteners, could be substituted for the zipper 310. Also, while the invention has been shown and described with a base support that includes substantially similar, mating, first and second side portions, those skilled in the art will appreciate that other configurations for folding the base support 302 to create a pouch 100 may be employed. As an example, the base support could be constructed to be folded twice to provide a cover for the pouch 100. Furthermore, although the pouch illustrated in the drawings is a relatively planar, substantially rectangular shape having two surfaces, those skilled in the art will appreciate that the hollow shell and base support can be collapsed and fastened into a plurality of shapes, e.g., cylindrical, triangular, spherical, etc.

A zipper 318 having mating teeth portions 320 and 322 is constructed to be fastened by a sliding member 324. The mating teeth portions 320 and 322 are fixed to the opening 308 in the side portion 304 so that the sliding member 324 can be moved to fasten the mating teeth portions 320 and 322 and thereby close the opening 308. Accordingly, the opening 308 cooperates with the bottom 300 and the zipper 318 to create a pocket for storage of objects when the hollow shell member 202 is folded and the zipper 310 is fastened to create the pouch 100.

Although the present invention has been described in terms of a preferred embodiment, it is not intended that the invention be limited to this embodiment. Modifications within the spirit of the invention will be apparent to those skilled in the art. The scope of the present invention is defined by the claims which follow.

I claim:

1. A bag for carrying objects wherein said bag is constructed to be collapsed into a pouch for easy carrying, said bag comprising:

a hollow shell member having first and second sides, said hollow shell member being formed from a first panel made of a substantially flexible material, said panel having a top and bottom edge and first and second side edges, said first and second side edges being joined to create said hollow shell member wherein said first and second sides are in opposing relationship and wherein said top and bottom edges of said panel correspond to top and bottom edges of said hollow shell member;

first and second handles for gripping the bag, said first and second handles being fixed to said first and second sides, respectively, at said top edge of said hollow shell member, said first and second handles being formed from strips of said substantially flexible material;

a bottom fixed to said bottom edge of said hollow shell member, said bottom being formed from a second panel of said substantially flexible material, said bottom having a first area and a first circumference sufficiently large to permit said hollow shell member to be folded upon said bottom so that said hollow shell member is positioned inside said first circumference of said bottom, said first area having a predetermined configuration;

a base support fixed to said bottom, said base support being formed from a third panel of a covering material, said covering material being stronger and more durable than said flexible material, said base support having a second circumference slightly larger than said first circumference and a second area having a configuration substantially corresponding to said predetermined configuration of said first area, said second area of said base support having a length and a width wherein said length is divided in substantial halves to define first and second side portions of said base support, said first side portion having an opening therein, said base support including a first zipper having first and second mating teeth portions that are constructed to be fastened by moving a first sliding member, said first and second mating teeth portions being fixed to the periphery of said first and second side portions, respectively, so that when said hollow shell member is folded upon said base support, said first and second side portions can be folded together and said first sliding member moved to fasten said first zipper and thereby create said pouch wherein said base support corresponds to a cover for said pouch; and a second zipper having third and fourth mating teeth portions constructed to be fastened by moving a second sliding member, said third and fourth mating teeth portions being fixed to said opening in said first side portion so that said second sliding member can be moved to fasten said third and fourth mating teeth portions and thereby close said opening, said opening cooperating with said bottom and said second zipper to create a pocket for storage of objects when said hollow shell member is folded and said first zipper is fastened to create said pouch.

2. A bag for carrying objects wherein said bag is constructed to be collapsed into a pouch for easy carrying, said bag comprising:

a hollow shell member having top and bottom edges and a throughole extending from said top edge to said bottom edge, said hollow shell member being formed from a first panel made of a substantially flexible material;

a bottom fixed to said bottom edge of said hollow shell member, said bottom being formed from a second panel of said substantially flexible material, said bottom having a first area and a first circumference sufficiently large to permit said hollow shell member to be folded upon said bottom so that said hollow shell member is positioned inside said first circumference of said bottom, said first area having a predetermined configuration; and a base support fixed to said bottom, said base support being formed from a third panel of a covering material, said covering material being stronger and more durable than said flexible material to add support to the bag and to protect said bottom, said base support having a second circumference slightly larger than said first circumference and a second area having a configuration substantially corresponding to said predetermined configuration of said first area, said second area of said base support having a length and a width wherein said length is divided in substantial halves to define first and second side portions of said base support, said base support including a first zipper having first and second mating teeth portions that are constructed to be fastened by moving a first sliding member, said first and second mating teeth portions being fixed to the periphery of said first and second side portions, respectively, so that when said hollow shell member is folded upon said base support, said first and second side portions can be folded together and said first sliding member moved to fasten said first zipper and thereby create said pouch wherein said base support corresponds to a cover for said pouch.

3. The bag as recited in claim 2 wherein said first side portion of said base support includes an opening, said bag further comprising:

a second zipper having third and fourth mating teeth portions constructed to be fastened by moving a second sliding member, said third and fourth mating teeth portions being fixed to said opening in said first side portion so that said second sliding member can be moved to fasten said third and fourth mating teeth portions and thereby close said opening, said opening cooperating with said bottom and said second zipper to create a pocket for storage of objects when said hollow shell member is folded and said first zipper is fastened to create said pouch.

4. A bag for carrying objects wherein said bag is constructed to be collapsed into a pouch for easy carrying, said bag comprising:

a hollow shell member havingtop and bottom edges and a throughole extending from said top edge to said bottom edge, said hollow shell member being formed from a first panel made of a substantially flexible material;

a bottom fixed to said bottom edge of said hollow shell member intermediate said base support and said hollow shell member, said bottom being formed from a second panel of said substantially flexible material; and a base support fixed to said bottom edge of said hollow shell member, said base support being formed from a third panel of a covering material, said covering material being stronger and more durable than said flexible material, said base support having an area of a size sufficient to permit said hollow shell member to be folded upon said base support so that said hollow shell member is positioned inside said area of said base support, said area of said base support having a length and a width wherein said length is divided in substantial halves to define first and second side portions of said base support, said base support including a first zipper having first and second mating teeth portions that are constructed to be fastened by moving a first sliding member, said first and second mating teeth portions being fixed to the periphery of said first and second side portions, respectively, so that when said hollow shell member is folded upon said base support, said first and second side portions can be folded together and said first sliding member moved to fasten said first zipper and thereby create said pouch wherein said base support corresponds to a cover for said pouch.

5. The bag as recited in claim 4 wherein said first side portion of said base support includes an opening, said bag further comprising:

a second zipper having third and fourth mating teeth portions constructed to be fastened by moving a second sliding member, said third and fourth mating teeth portions being fixed to said opening in said first side portion so that said second sliding member can be moved to fasten said third and fourth mating teeth portions and thereby close said opening, said opening cooperating with said bottom and said second zipper to create a pocket for storage of objects when said hollow shell member is folded and said first zipper is fastened to create said pouch.

6. A bag for carrying objects wherein said bag is constructed to be collapsed into a pouch for easy carrying, said bag comprising:

enclosing means for providing the sides of the bag, said enclosing means having top and bottom edges and a thronghole extending from said top edge to said bottom edge, said enclosing means being formed from a substantially flexible material:

a bottom fixed to said bottom edge of said enclosing means, said bottom being formed from said substantially flexible material; and protecting means for providing the base of the bag, said protecting means being fixed to said bottom, said protecting means being formed from a covering material, said covering material being selected to be stronger and more durable than said flexible material, said protecting means having an area of a size sufficient to permit said enclosing means to be folded upon said protecting means, said area of said protecting means including first and second portions, said protecting means including fastener means fixed to the periphery of said first and second portions for fastening said first portion to said second portion so that when said enclosing means is folded upon said protecting means, said first and second portions can be fastened together thereby to create said pouch wherein said protecting means corresponds to a cover for said pouch.

7. The bag as recited in claim 6 wherein said first side portion of said protecting means includes an opening, said bag further comprising:

second fastener means for closing said opening, said opening cooperating with said bottom and said second fastener means for creating a pocket for storage of objects when said enclosing means is folded and said fastener means is fastened to create said pouch.

* * * * *

UNITED STATES PATENT AND TRADEMARK OFFICE

CERTIFICATE OF CORRECTION

PATENT NO. : 5,399,020

DATED : March 21, 1995

INVENTOR(S) : Flora Cheng

It is certified that error appears in the above-identified patent and that said Letters Patent is hereby corrected as shown below:

In column 5, claim 4, line 53, please delete "havingtop" and substitute therefor --having top--.

In column 6, claim 6, line 37, please delete "thronghole" and substitute therefor --throughole--.

Signed and Sealed this

Twelfth Day of September, 1995

*Attest:*

Bruce Lehman

BRUCE LEHMAN

*Attesting Officer*

*Commissioner of Patents and Trademarks*